US005114270A

United States Patent [19]

Riddle

[11] Patent Number: 5,114,270

[45] Date of Patent: May 19, 1992

[54] BARRIER APPARATUS

[76] Inventor: James J. Riddle, 41 Springside Ave., Pittsfield, Mass. 01201

[21] Appl. No.: 673,308

[22] Filed: Mar. 22, 1991

[51] Int. Cl.[5] ..... E02B 7/04

[52] U.S. Cl. ..... 405/15; 405/32; 405/258; 405/284; 256/13; 52/102; 52/593

[58] Field of Search ..... 405/30, 32, 31, 35, 405/107, 110, 284, 258, 15, 16, 18; 52/102, 593; 256/12.5, 13

[56] References Cited

U.S. PATENT DOCUMENTS

| | | | |
|---|---|---|---|
| 1,684,050 | 9/1928 | Adams | 52/593 |
| 3,269,125 | 8/1966 | Moore | 405/15 |
| 4,756,511 | 7/1988 | Wright | 256/12.5 |
| 4,909,666 | 3/1990 | Takasaki | 405/115 |

FOREIGN PATENT DOCUMENTS

| | | | |
|---|---|---|---|
| 2755833 | 7/1978 | Fed. Rep. of Germany | 405/15 |
| 3831605 | 3/1990 | Fed. Rep. of Germany | 52/593 |
| 637057 | 3/1962 | Italy | 52/593 |
| 85040 | 5/1920 | Switzerland | 405/107 |

*Primary Examiner*—Dennis L. Taylor
*Assistant Examiner*—Arlen L. Olsen
*Attorney, Agent, or Firm*—Leon Gilden

[57] ABSTRACT

An apparatus wherein individual lock members include interconnecting right and left end walls, with spikes directed through the top and botttom wall for positioning and securement of the barriers to an underlying support or to one another. A fabric flap is mounted to a forward planar wall of each of the blocks for enhanced mounting of the blocks to an underlying surface to minimize cantilevering of the blocks in use. Further, positioning blocks are selectively securable to a top surface of each block and cooperative with rectangular recesses within opposed bottom surfaces of further blocks to provide vertical mounting of the blocks together.

4 Claims, 4 Drawing Sheets

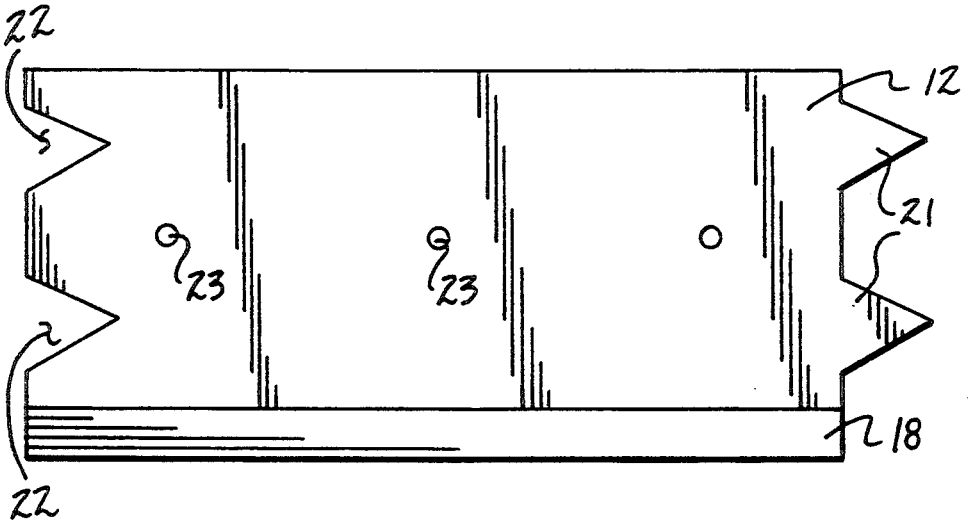
Fig 2
Fig 3
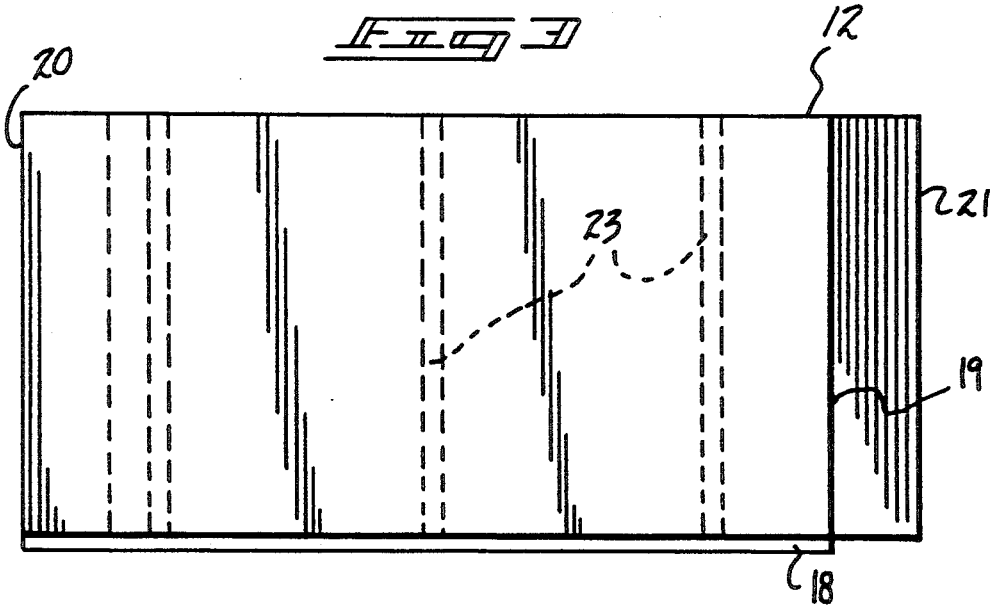

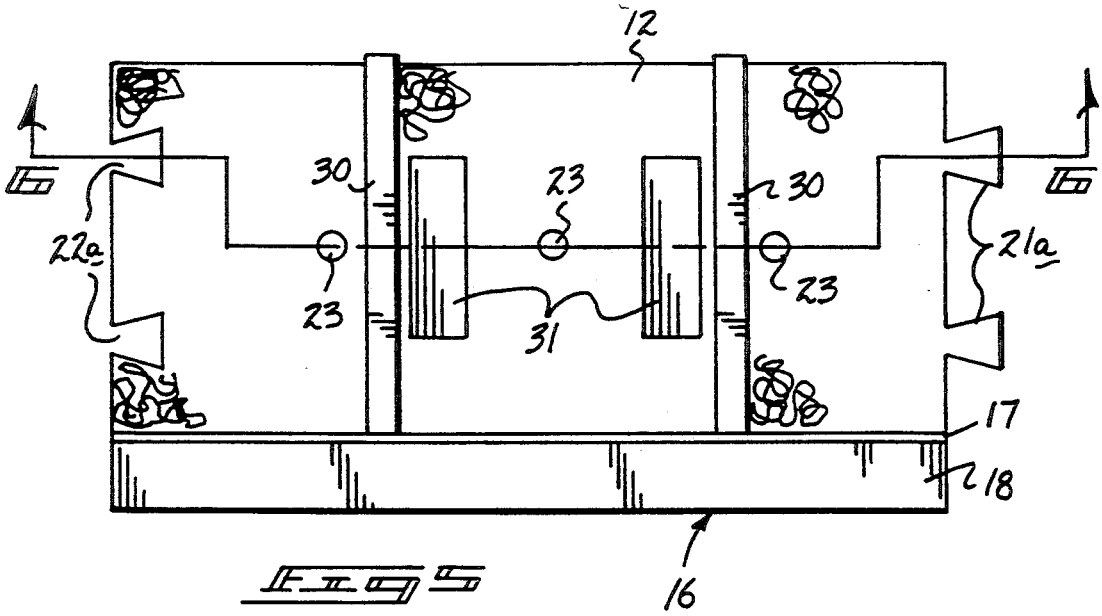
FIG 5
FIG 6
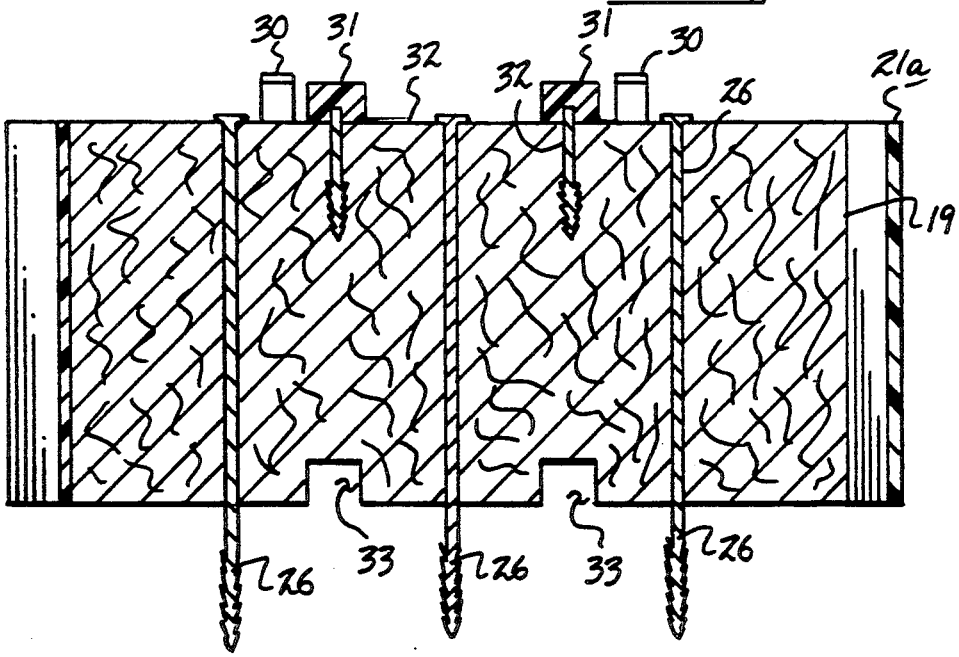

BARRIER APPARATUS

BACKGROUND OF THE INVENTION

1. Field of the Invention

The field of invention relates to barrier apparatus, and more particularly pertains to a new and improved barrier apparatus wherein the same is arranged for providing a barrier structure to thwart erosion and the like due to wate flow, soil flow, and the like.

2. Description of the Prior Art

Various barrier structure is utilized in the prior art to provide a fencing or barrier arrangement for use in areas requiring a quick and expendient wall structure to be formed in confrontation with flood waters, soil flow, and the like. Such prior art may be found in U.S. Pat. No. 4,756,511 to Wright wherein a fence structure utilizes a plurality of spaced stakes utilizing a fabric fence therebetween.

U.S. Pat. No. 731,320 to Newell sets forth a guard for railroad tracks and the like wherein a rigid structure is formed of a planar barrier plate mounted to an underlying support base.

U.S. Pat. No. 3,082,993 to Loudon sets forth a barrier fence structure utilizing predetermined fasteners to connect each of the vertical slots of a fence together.

U.S. Pat. No. 3,966,172 to Garrett sets forth a fence structure for mounting against shifting sand, snow, and the like.

As such, it may be appreciated that there continues to be a need for a new and improved barrier apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of barrier apparatus now present in the prior art, the present invention provides a barrier apparatus wherein the same utilizes polymeric fibrous blocks mounted in an interlocking relationship relative to one another to provide a barrier structure relative to shifting soil, water flow, and the like. As such, the general purpose of the present invention, which will be described subsequently in greater detail, is to provide a new and improved barrier apparatus which has all the advantages of the prior art barrier apparatus and none of the disadvantages.

To attain this, the present invention provides an apparatus wherein individual lock members include interconnecting right and left end walls, with spikes directed through the top and bottom wall for positioning and securement of the barriers to and underlying support or to one another. A fabric flap is mounted to a forward planar wall of each of the blocks for enhanced mounting of the blocks to an underlying surface to minimize cantilevering of the block in use. Further, positioning blocks are selectively securable to a top surface of each block and cooperative with rectangular recesses within opposed bottom surfaces of further blocks to provide vertical mounting of the blocks together.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved barrier apparatus which has all the advantages of the prior art barrier apparatus and none of the disadvantages.

It is another object of the present invention to provide a new and improved barrier apparatus which may be easily and efficiently manufactured and marketed.

It is a further object of the present invention to provide a new and improved barrier apparatus which is of a durable and reliable construction.

An even further object of the present invention is to provide a new and improved barrier apparatus which is susceptible of a low cost of manufacture with regard to both materials and labor, and which accordingly is then susceptible of low prices of sale to the consuming public, thereby making such barrier apparatus economically available to the buying public.

Still yet another object of the present invention is to provide a new and improved barrier apparatus which provides in the apparatuses and methods of the prior art some of the advantages thereof, while simultaneously overcoming some of the disadvantages normally associated therewith.

Still another object of the present invention is to provide a new and improved barrier apparatus wherein the same utilizes parallelepiped blocks arranged for interfitting and locking relative to one another to provide a vertical wall structure to provide a barrier organization minimizing soil and water flow, as well as snow and other forms of shifting particles.

These together with other objects of the invention, along with the various features of novelty which characterize the invention, are pointed out with particularity in the claims annexed to and forming a part fo this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. such description makes reference to the annexed drawings wherein:

FIG. 2 is an orthographic top view of the instant invention.

FIG. 4 is an isometric illustration of a modified aspect of the invention.

FIG. 5 is an orthographic top view in a modified aspect of the instant invention.

FIG. 6 is an orthographic view, taken along the lines 6—6 of FIG. 5 in the direction indicated by the arrows.

DESCRIPTION OF THE PREFERRED EMBODIMENT

Figure 1:
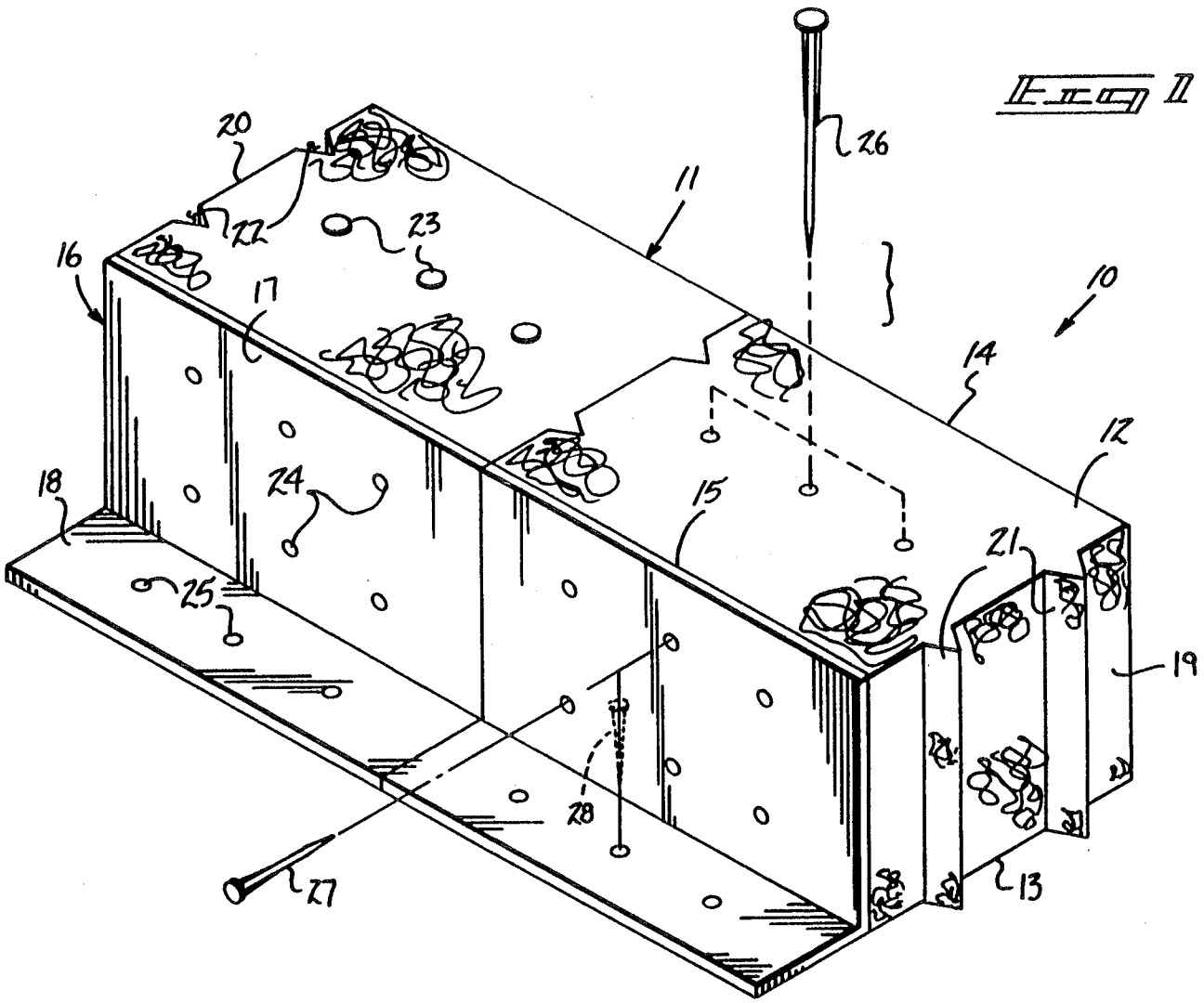
FIG. 1 is an isometric illustration of the instant invention.
Figure 3:
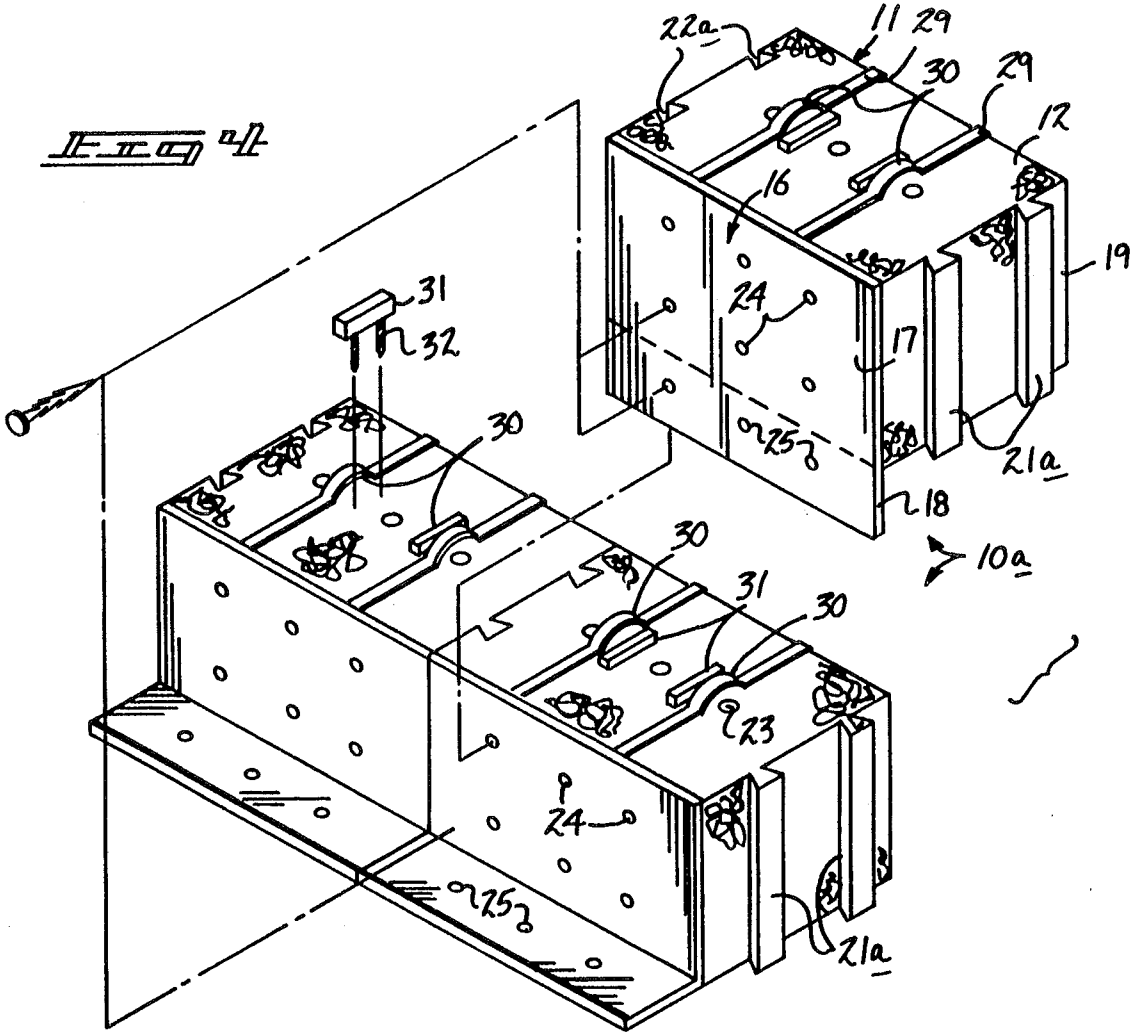
FIG. 3 is an orthographic side view of the instant invention.

With reference now to the drawings, and in particular to FIGS. 1 to 6 thereof, a new and improved barrier apparatus embodying the principles and concepts of the present invention and generally designated by the reference numerals 10 and 10*a* will be described.

More specifically, the barrier apparatus 10 of the instant invention essentially comprises a wall structure that may be formed of individual barrier blocks 11 formed of a polymeric fiber matrix. Each of the blocks are of a generally parallelepiped configuration, including a planar top wall 12 spaced above and parallel to a bottom wall 13. A planar rear wall 14 is spaced from a parallel planar forward wall 15. Right and left respective end walls 19 and 20 are arranged orthogonally relative to the top, bottom, rear, and forward walls. An "L" shaped vertical web screen 16 is mounted to the planar forward wall 15 defining a vertical screen plate 17 coextensively mounted to the forward wall 15, with a horizontal screen plate 18 directed forwardly of the vertical screen plate 17 for securement to an underlying surface to provide enhanced securement of the barrier block 11 to an underlying surface minimizing cantilevering of the block when pressure is applied to the forward wall 15. The right end wall 19 includes a plurality of parallel ribs 21 directed coextensively and orthogonally between the planar top wall 12 and planar bottom wall 13. The parallel ribs 21 are spaced apart a predetermined spacing and may be formed as a triangular cross-sectional configuration or of trapezoidal cross-sectional configuration utilizing the parallel ribs 21*a*, as illustrated in FIG. 4 for example. Parallel grooves 22 (see FIG. 1) or grooves 22*a* (see FIG. 4) are of a complementary cross-sectional configuration to the respective parallel ribs 21 or 21*a* to receive such ribs and mount the blocks in an aligned configuration, as illustrated in FIG. 4 for example. First bores 23 are directed orthogonally through the barrier block 11 extending from the top wall 12 through the bottom wall 13 and thereafter extending below the bottom wall 13 (see FIG. 6) for mounting into an underlying support. The first pins 26 are of a first length greater than a spacing between the top wall and bottom wall 12 and 13, including a serrated shank. The first pins 26 are directed through the first bores 23. Second bores 24 are directed orthogonally into the vertical screen plate 17 and receive second pins 27 therewithin of a second length to mount the vertical screen plate 17 in coextensive relationship relative to the planar forward wall 15. The horizontal screen plate 18 includes third bores 25 to receive third pins 28, also of substantially the second length, to assist in mounting the horizontal screen plate 18 to an underlying surface in association with the first pins 26.

Reference to FIGS. 4–6 illustrates the use of straps 29 mounted fixedly to the planar top wall 12 directed orthogonally between the planar rear wall 13 and the planar forward wall 15. The straps 29 include handle loops 30 mounted medially thereof, wherein a plurality of such straps and handle loops are utilized to permit ease of manual manipulation of the blocks 11.

Further, positioning blocks 31 defined by a predetermined configuration are selectively mounted upon the planar top wall 12 utilizing serrated shank block mounting spikes 32 fixedly mounted within each of the positioning blocks 31 directed orthogonally through the bottom surface thereof, and are mounted to the top wall 12 a further predetermined spacing. Recesses 33 defined by a predetermined configuration substantially equal to a predetermined configuration defined by the mounting blocks 31 complementarily receive a mounting block 31 within each respective recess 33 which are also spaced apart the further predetermined spacing to permit enhanced aligning and positioning of the blocks relative to one another in a vertical orientation, as illustrated in FIG. 4 for example. In this manner, the horizontal screen plate 18 is oriented downwardly to align the horizontal screen plate 18 with the vertical screen plate 17 to align the third bores 25 with the second bores 24 of an underlying block.

As it is to be understood, a polymeric fiber matrix forming the barrier blocks 11 are sufficiently dense to permit fluid seepage therethrough but prevent water flow in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A barrier apparatus comprising, a barrier block defined by a parallelepiped configuration, including a planar top wall, a planar bottom wall, a planar rear wall, and a planar forward wall, the barrier block includes a right end wall spaced from a left end wall, and the right end wall includes a plurality of parallel ribs defined apart a predetermined spacing, the parallel ribs are defined by a predetermined cross-sectional configuration, and the left end wall includes a plurality of parallel grooves, the parallel grooves defined by the predetermined cross-sectional configuration and spaced apart the predetermined spacing, and the parallel ribs and the parallel grooves extend orthogonally between the planar top wall and the planar bottom wall, and a plurality of first bores orthogonally directed from the top wall through to the bottom wall, and a plurality of first spikes receivable within the first bores, wherein the first spikes extend exteriorly of the planar bottom wall when the spikes are directed into the first bores, and, a flexible web screen coextensively mounted to the planar forward wall, wherein the flexible web screen includes a vertical screen plate coextensively mounted overlying the forward wall, and a horizontal screen plate extending beyond the vertical screen plate, and the vertical screen plate including second bores including second pins directed into the second bores receivable within the barrier block through the planar forward wall, and the horizontal screen plate including third bores receiving third pins for mounting the horizontal screen plate to an underlying surface.

2. An apparatus as set forth in claim 1 wherein the barrier block is formed of a fluid permeable polymeric fiber matrix.

3. An apparatus as set forth in claim 2 including a plurality of straps fixedly mounted to the planar top wall, the straps each include a handle loop mounted medially of each strap, wherein the straps extend orthogonally between the planar rear wall and the planar forward wall.

4. An apparatus as set forth in claim 3 including a plurality of positioning blocks mounted fixedly to the barrier block mounted into the planar top wall, and each of the positioning blocks are defined by a further predetermined configuration and each of the positioning blocks include a plurality of serrated shank block mounting spikes orthogonally mounted downwardly relative to each positioning block receivable within the barrier block through the planar top wall, each of the positioning blocks are spaced apart a further predetermined spacing, and the planar bottom wall includes a plurality of recesses directed therewithin, each of the recesses is formed of a configuration equal to the further predetermined configuration and spaced apart the further predetermined spacing to receive the positioning blocks underlying barrier block therewithin.

* * * * *